United States Patent [19]

Stelzer, Jr.

[11] Patent Number: 4,966,496

[45] Date of Patent: Oct. 30, 1990

[54] METHOD OF ERECTING OFFSHORE PLATFORMS

[75] Inventor: Clarence F. Stelzer, Jr., Houston, Tex.

[73] Assignee: O. C. S. Operators, Inc., Baytown, Tex.

[21] Appl. No.: 404,678

[22] Filed: Sep. 8, 1989

[51] Int. Cl.[5] ..... E02B 17/06

[52] U.S. Cl. ..... 405/227; 405/232; 405/204

[58] Field of Search ..... 405/201, 222, 224, 227, 405/250, 251, 232; 182/178

[56] References Cited

U.S. PATENT DOCUMENTS

| | | | |
|---|---|---|---|
| 307,541 | 11/1884 | Gray et al. | 405/251 |
| 3,003,323 | 10/1961 | Holt | 405/251 |
| 4,090,798 | 5/1978 | Barton | 182/178 X |
| 4,669,918 | 6/1987 | Riles | 405/227 |
| 4,740,107 | 4/1988 | Casbarian et al. | 405/204 X |
| 4,812,080 | 3/1989 | Urquhart et al. | 405/227 |
| 4,818,145 | 4/1989 | Carruba | 405/227 X |

OTHER PUBLICATIONS

Stelzer, C. F., "The Guardian: A Cost Effective Offshore Structure", Paper Presented at ASMA Meeting, Jan. 23, 1989, Houston, Texas.

Littleton, J. "Minimal Platforms Booming in Shallow U.S. Gulf Water", Offshore, pp. 22-28, Nov. 1988.

*Primary Examiner*—Dennis L. Taylor
*Assistant Examiner*—Arlen L. Olsen
*Attorney, Agent, or Firm*—Vaden, Eickenroht, Thompson & Boulware

[57] ABSTRACT

Method of erecting a minimal structure offshore platform around an existing caisson or drive pipe without any bolted, grouted, or underwater welded connections. This method involves the welding of a stop ring onto the caisson at a point just above the water line. A template having two sleeves for receiving piles and a sleeve for receiving a caisson is lowered over the caisson until the template rests on the stop ring. The template is concentrically aligned by a shim mounted to the top of the caisson sleeve. The caisson sleeve is centered around the caisson by inserting shims between the caisson and the caisson sleeve, and then the caisson sleeve is welded to the caisson and the stop ring. Piles are driven through the pile sleeves to grade using shims on the high point of the pile sleeve to align the pile with the axis of the sleeve as the pile sections are welded together. Once the piles are driven, the pile sleeves are centered around the piles by inserting shims between the piles and the piles sleeves. The pile sleeves are then welded to the piles. The deck of the structure is then installed using the template as the support.

7 Claims, 1 Drawing Sheet

FIG. 1
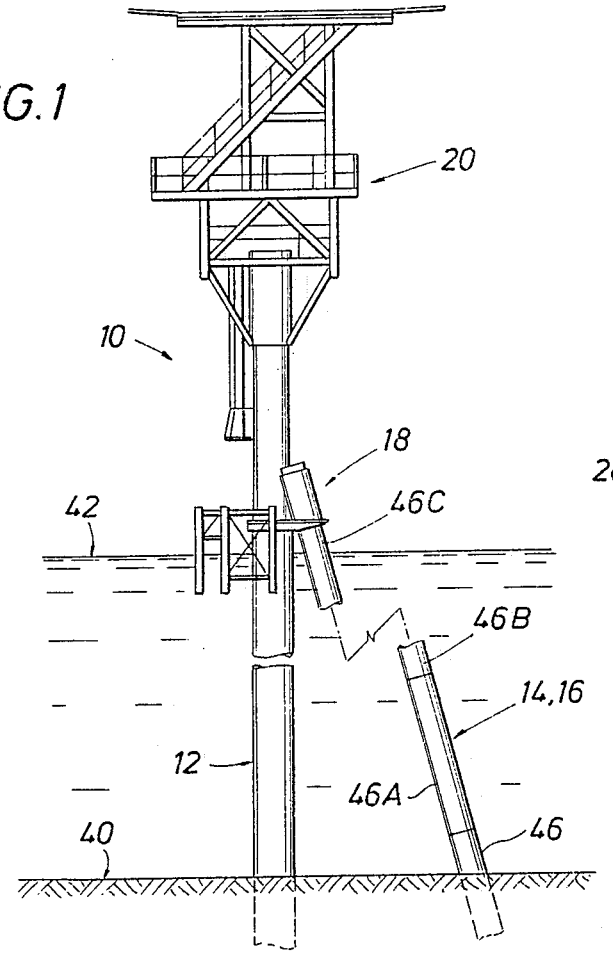
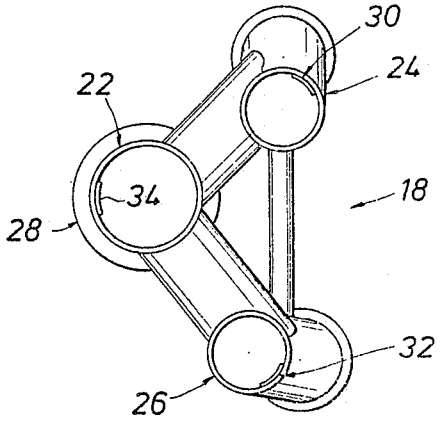
FIG. 2
FIG. 3
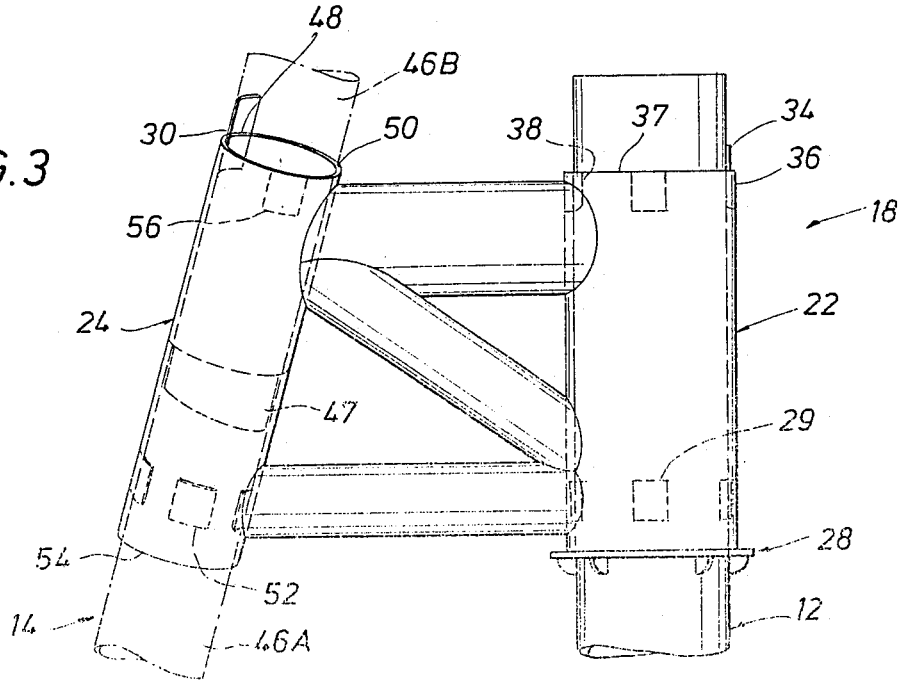

METHOD OF ERECTING OFFSHORE PLATFORMS

BACKGROUND OF THE INVENTION

This invention pertains to fixed offshore platform construction and erection and, more specifically, to a simplified, cost effective method of erecting an offshore platform that requires the driving of only two piles in a manner which allows all welds to be made above the water line.

Offshore platforms can be categorized generally as being submersible, semisubmersible, jackup or fixed. Although all have their advantages and advocates, fixed platform construction is in widespread use.

Minimal structure fixed platforms are advantageous in shallow water, calm-weather regions such as the Gulf of Mexico where these platforms are installed in depths of 30–300 feet. Because these minimal structure platforms cost much less than a traditional full structure platform, they are particularly favored by cost-conscious and tight-budget operators.

There are numerous varieties of minimal structure platforms offering different load capabilities at a range of depths. Almost all consist of a jacket including tubular sleeves for receiving piles driven through the sleeves and into the seabed floor. Once the pilings have been driven to grade in the seabed, most designs fix the jacket to the pilings by some combination of grouting, bolting, or welding. The upper decking and equipment are then mounted to the jacket to complete the platform.

Minimal structure platforms differ from full structure platforms because minimal structure platforms are constructed with a smaller jacket assembly and fewer pilings. Some use the drive pipe, or caisson, as one of the legs for support. For instance, on information and belief, Barnett and Casbarian, Inc. (Metarie, La.) has designed a platform that is clamped to the side of the caisson at points above and below the water line. Piles are then driven through three sleeves to anchor the platform adjacent the caisson. CBS Engineering (Houston, Tex.) markets a design of minimal structure platform known as the Moss III, which uses a tripod support system with the caisson serving as one of the support legs.

Other minimal structure platforms include a so-called chopped tripod that is designed, on information and belief, by Mustang Engineering (Houston, Tex.) and which uses a tripod base to support the caisson. By supporting the caisson in that manner, the caisson can be used as the sole support for a platform. Likewise, the Moss II (CBS Engineering (Houston, Tex.)) and so-called T-Horse (Atlanta Engineering (Houston, Tex.)) are designs which rely on the caisson as the sole support.

Although all of these minimal structure platforms are easier and cheaper to construct and erect than a full structure platform, the method of the present invention offers several significant advantages over these other minimal structure platforms. For instance, it is a feature of the present invention that all required connections can be made by welding and that all welds are made above water. The present invention does not require any grouting, bolting, clamping, or underwater welding. Because all of the connections are above water welds, the method of the present invention simplifies the erection of the platform.

Minimal structure offshore platforms of the type which allow all welds to be made above the water line have been designed by Petro-Marine Engineering of Texas, Inc. (Houston, Tex.) and several, know as "Guardian" platforms, have been erected in the Gulf of Mexico. In erecting those platforms, which is accomplished in part by driving a pile section through an angled and canted sleeve and then welding another pile section onto the section driven through the sleeve and repeating those steps until the pile is driven to grade, a problem was encountered with alignment of successive pile sections and the effect of that alignment problem on the stance of the platform. Specifically, because the force of gravity pulls a pile section straight downwardly while the sleeve in which it is positioned is angled and canted with respect to the vertical, the pile section tends toward a slight angle with respect to the axis of the cylinder represented by the sleeve. That tendency makes alignment of a pile section driven through the sleeve with the next pile section to be welded in place more difficult; precise alignment is almost impossible. Consequently, as successive pile sections are welded in place, the pile begins to curve away from the axis of the sleeve with the result that the triangular stance of the platform on the ocean floor is of smaller dimensions, decreasing the stability of the platform. Further, even if precise alignment could be effected, the result would still be a pile which droops, e.g., tends downwardly away from the axis of the sleeve simply because of the effect of gravity.

It is, therefore, another feature of the method of the present invention to align the pile sections by using a shim mounted to the high side of each of the pile sleeves. These shims also act as a guide for the piles during driving to ensure that the piles enter the seabed floor at the proper angle.

It is still another feature of the present invention to insert shims between the piles and the pile sleeves to aid in centering the piles in the sleeves. Centering the piles in the pile sleeves is advantageous in making the weld between the pile and the pile sleeve and makes the weld stronger.

It is still another feature of the present invention to mount a plurality of shims to the top of the caisson sleeve. The shims maintain proper spacing between the caisson and the template including the pile sleeve so as to facilitate the welding of the caisson to the template.

SUMMARY OF THE INVENTION

These objects and features, and the advantages, of the present invention are achieved by providing a method of erecting a minimal structure offshore platform using a well caisson extending out of the water as a support member comprising the steps of:

(a) welding a stop ring onto a caisson extending out of the water at a point above the water line;

(b) lowering a template having first and second sleeves for receiving piles therethrough and a third sleeve for receiving the caisson therethrough down over the caisson until the margins of the third sleeve engage the stop ring so that the template rests thereon;

(c) welding the third sleeve to the stop ring and caisson;

(d) lowering a first pile section through the first sleeve of the template and then extending the pile by welding additional pile sections thereto in serial fashion using a shim plate mounted on the high point of the first sleeve to align each pile section with the first sleeve until the pile is driven to grade;

(e) welding the pile to the first sleeve after the pile has been driven to grade by inserting a plurality of shims between the pile and pile sleeve to center the pile in the pile sleeve;

(f) repeating steps (b)-(e) for the second sleeve; and (g) erecting a deck using the template for support.

BRIEF DESCRIPTION OF THE DRAWINGS

FIG. 1 is a side view of a completed offshore platform erected in accordance with the preferred method of the present invention.

FIG. 2 is a top, plan view of the template used for erecting an offshore platform in accordance with the method of the present invention.

FIG. 3 is a side, partially schematic, view of the template of FIG. 2 after the template has been lowered over a caisson.

DETAILED DESCRIPTION OF THE PREFERRED EMBODIMENT

Now referring to FIG. 1, a fixed offshore platform 10 installed in accordance with the present invention is shown. The platform 10 includes a caisson or drive pipe 12, two pilings 14 and 16 of which only pile 16 is visible in FIG. 1, a template 18 secured to the caisson 12 and pilings 14 and 16 as later explained, and a deck 20 installed to the top of the template in conventional fashion.

FIG. 2 shows a top view of the template 18 consisting of three sleeves, caisson sleeve 22, first pile sleeve 24, and second pile sleeve 26. The two pile sleeves 24 and 26 are both canted and angled so that a stable tripod base is formed with caisson 12 when the piles 14 and 16 are driven through the sleeves. These three sleeves are connected by structural cross-members (not numbered) to form the template 18.

FIG. 3 shows a side view of the template 18 with the caisson sleeve 22 fitted over the caisson 12 and supported by the stop ring 28. Attached to the high points of the two pile sleeves 24 and 26 are shim plates 30 and 32, of which only shim plate 30 is visible in FIG. 3, the purpose of which is to align and guide the piles 14 and 16 during driving as will be explained.

Referring to FIGS. 1-3, to erect a fixed offshore platform 10 in accordance with the present invention, the stop ring 28 is lowered over the caisson 12 and welded to the caisson 12 at a point above the water line 42. The template 18 is then lifted up over and lowered down around the caisson 12 with the caisson sleeve 22 receiving the caisson 12 therethrough (e.g., the template 18 is "stabbed" over caisson 12) until the lower margin of the caisson sleeve 22 engages stop ring 28 so that the template 18 rests thereon. A plurality of spacers 29 are mounted to the inside of caisson sleeve 22 near the lower margin thereof for centering caisson sleeve 22 around caisson 12.

A shim plate 34 is mounted to the high point 36 of the caisson sleeve 22 and is used to align the longitudinal axis of caisson sleeve 22 with the longitudinal axis of the caisson 12. The shim plate 34 facilitates the welding by preventing rotational movement of the template 18 with respect to the caisson 12; high point 36 is so-named because, if template 18 were able to rotate such that the axis of caisson sleeve 22 was not coincident with the axis of caisson 12, the point 36 at the top margin 37 of caisson sleeve 22 would be the highest point on the sleeve 22. Once the caisson sleeve 22 is resting on the stop ring 28 and the longitudinal axis thereof is aligned with that of caisson 12, the caisson sleeve 22 is welded to stop ring 28 and caisson 12. A plurality of shims 38 of similar dimensions to shim plate 34 are inserted between caisson 12 and the top margin 37 of caisson sleeve 22. Shims 38 serve the dual function of helping to center caisson 12 in caisson sleeve 22 and providing support for the welding bead around the top margin 37 of caisson sleeve 22.

A first pile section 46 is lowered through the first pile sleeve 24 and then extended by welding additional pile sections 46A, 46B, etc. thereto in serial fashion. A shim plate 30 is mounted to the high point 48 of pile sleeve 24; again, high point 48 is so-named because that point on the top margin 50 of pile sleeve 24 is highest when template 18 is welded onto caisson 12. Once one of the pile sections 46A, B, etc. is lowered through sleeve 24, shim plate 30 prevents rotational movement of the pile section 46A, B, etc. with respect to pile sleeve 24, thereby maintaining the alignment of the longitudinal axes of pile sleeve 24 and pile 14. As used herein with respect to the function of shim plate 30 (and shim plate 32 as described below), the word "align" refers to the alignment of each pile section 46A, 46B, etc., and the pile 14, with the longitudinal axis of pile sleeve 24. A plurality of spacers 52 are mounted to the inside surface of pile sleeve 24 at a point near the lower margin 54 of pile sleeve 24 to center each pile section 46A, 46B, etc. therein.

Each pile section 46B, 46C, etc. is aligned with the previous pile section 46A, 46B, etc. resting in pile sleeve 24 by a stabbing guide 47 extending from one end thereof which is received within the open end of each pile section 46A, 46B, etc. to extend pile 14 until the pile 14 is driven to grade into the seabed floor 40. Once the pile 14 has been driven to grade through the first pile sleeve 24, a plurality of shims 56 of dimensions similar to those of shim plate 30 are inserted between the pile 14 and the top of pile sleeve 24 to center the pile 14 in the pile sleeve 24. The pile 14 is then welded to the pile sleeve 24, the shims 56 serving as a support for the weld bead.

The second pile 16 is lowered and driven through the second pile sleeve 26 using the shim plate 32 for alignment in the same manner as shim plate 30 is used for alignment of the first pile 14. After the second pile 16 is driven to grade through the second pile sleeve 26, the second pile 16 is then centered and welded using shims (not shown) to the second pile sleeve 26 in the same manner as the first pile 14. After both piles 14 and 16 are driven to grade and welded to the template 18, the deck 20 is erected using the template 18 for support.

From the foregoing, it will be seen that this invention is adapted to attain all the ends and objects hereinabove set forth, together with other advantages which are obvious to those skilled in the art who have the benefit of this disclosure and which are inherent to the apparatus and structure. It will be understood that certain features and subcombinations of the invention ar of separate utility and may be employed without reference to other features and subcombinations. Such combinations are contemplated by and within the scope of the attached claims.

Because many possible embodiments may be made of the invention without departing from the scope thereof, it is to be understood that all matters herein set forth and shown in the accompanying drawings are to be interpreted as illustrative and not in a limiting sense.

What is claimed is:

1. A method of erecting a minimal structure offshore platform using a well caisson extending out of the water as a support member comprising the steps of:

(a) welding a stop ring onto a caisson extending above the waterline at a point above the waterline;

(b) lowering a template having first and second sleeves for receiving piles therethrough and a third sleeve for receiving the caisson therethrough over the caisson until the template rests upon the stop ring;

(c) welding the third sleeve to the stop ring and the caisson;

(d) lowering a first pile section through the first sleeve of the template;

(e) using a shim mounted on the high point of the first sleeve to align the first pile section and the first sleeve;

(f) aligning and welding additional pile sections to the first pile section lowered through the first sleeve until the pile has been driven to grade;

(g) welding the driven pile to the first sleeve;

(h) repeating steps (d)–(g) for the second sleeve; and (i) supporting a deck with the template having the piles welded thereto.

2. The method of claim 1 additionally comprising aligning the longitudinal axis of the third sleeve of the template with the longitudinal axis of the caisson to facilitate the welding of the template to the caisson by preventing rotational movement of the template with respect to the caisson.

3. The method of claim 1 additionally comprising centering the driven first and second piles in the first and second sleeves, respectively, by inserting a plurality of shims between the driven first and second piles and the respective first and second sleeves.

4. The method of claim 1 wherein the shim mounted on the high point of the first and second sleeves prevents rotational movement of the pile sections with respect to the first and second sleeves, respectively.

5. A method of erecting an offshore platform for which the well caisson serves as a support member comprising the steps of:

(a) welding a stop ring onto a caisson extending out of the water at a point above the water line;

(b) lowering a template having first and second sleeves for receiving piles therethrough a third sleeve for receiving the caisson until the template rests on the stop ring;

(c) welding the caisson to the third sleeve;

(d) lowering a pile section through the first sleeve of the template;

(e) aligning the longitudinal axes of the pile section and the first sleeve using a shim mounted on the high point of the first sleeve to prevent rotational movement of the pile section with respect to the first sleeve;

(f) aligning and welding additional pile sections to the pile section lowered through the first sleeve until a first pile resulting from the addition of the pile sections has been driven to grade;

(g) welding the driven first pile to the first sleeve;

(h) repeating steps (d)–(f) with additional pile sections in the second sleeve to drive a second pile to grade;

(i) welding the second pile to the second sleeve; and (j) supporting a deck with the template having the first and second piles welded thereto.

6. The method of claim 5 additionally comprising aligning the longitudinal axes of the third sleeve of the template and the caisson to facilitate welding of the template to the caisson by preventing rotational movement of the template with respect to the caisson.

7. The method of claim 5 additionally comprising centering the driven first and second piles in the first and second sleeves, respectively, by inserting a plurality of shims between the driven first and second piles and the respective first and second sleeves.

* * * * *